US005540992A

United States Patent [19]

Marcher et al.

[11] Patent Number: 5,540,992

[45] Date of Patent: Jul. 30, 1996

[54] POLYETHYLENE BICOMPONENT FIBERS

[75] Inventors: Bjørn Marcher; Erik Nielsen, both of Varde; Pia H. Hansen, Tistrup, all of Denmark

[73] Assignee: Danaklon A/S, Varde, Denmark

[21] Appl. No.: 170,279

[22] PCT Filed: Jun. 30, 1992

[86] PCT No.: PCT/DK92/00210

§ 371 Date: Mar. 7, 1994

§ 102(e) Date: Mar. 7, 1994

[87] PCT Pub. No.: WO93/01334

PCT Pub. Date: Jan. 21, 1993

[30] Foreign Application Priority Data

May 7, 1991 [DK] Denmark ..... 1321/91

[51] Int. Cl.[6] ..... D02G 3/00

[52] U.S. Cl. ..... 428/373; 428/364; 428/288; 428/296; 428/349; 428/347; 428/516; 428/910

[58] Field of Search ..... 428/373, 364, 428/288, 296, 349, 347, 516, 910; 156/167, 213, 181, 296, 306, 374, 371, 370, 229; 526/348, 348.2, 348.6

[56] References Cited

U.S. PATENT DOCUMENTS

| | | | |
|---|---|---|---|
| 3,584,339 | 6/1971 | Kamachi et al. . | |
| 4,189,338 | 2/1980 | Ejima et al. | 156/167 |
| 4,316,970 | 2/1982 | Hughes | 525/240 |
| 4,390,385 | 6/1983 | Ferguson et al. | 156/229 |
| 4,522,868 | 6/1985 | Ohuchi et al. . | |
| 4,643,945 | 2/1987 | Kiang | 428/349 |
| 4,644,045 | 2/1987 | Fowells | 526/348 |
| 4,717,325 | 1/1988 | Fujimura et al. . | |

FOREIGN PATENT DOCUMENTS

| | | |
|---|---|---|
| 0248598A3 | 12/1987 | European Pat. Off. . |
| 0277707A3 | 8/1988 | European Pat. Off. . |
| 0340763 | 11/1989 | European Pat. Off. . |
| 0340763A1 | 11/1989 | European Pat. Off. . |
| 0421734 | 4/1991 | European Pat. Off. . |
| 2121423 | 12/1983 | United Kingdom . |
| 2125458 | 3/1984 | United Kingdom . |

OTHER PUBLICATIONS

Dr. Ing. Bodo Carlowitz, "Kunststoff–Tabellen", 3rd edition, 1986, pp. 86, 87 96.

M. Grayson, "Encyclopedia of Textiles, Fibers, and Non-woven Fabrics", 1984, p. 290.

M. Ahmed, "Polypropylene Fibers—Science and Technology", 1982, pp. 329–346.

Patent Abstracts of Japan, vol. 14, No. 522 (JP–A–2 216 251).

Patent Abstracts of Japan, vol. 13, No. 49 (JP–A–63 243 324).

*Primary Examiner*—Patrick J. Ryan
*Assistant Examiner*—Merrick Dixon
*Attorney, Agent, or Firm*—Birch, Stewart, Kolasch & Birch, LLP

[57] ABSTRACT

Thermobondable bicomponent synthetic fibers comprising a high-melting core component comprising a high density polyethylene with a density of more than 0.950 g/cm$^3$, and a low-melting sheath component comprising a linear low density polyethylene with a density of less than 0.945 g/cm$^3$, typically 0.921–0.944 g/cm$^3$ are suitable for use in making non-woven fabrics. The fibers are particularly suitable for the preparation of thermally bonded non-woven fabrics for medical use and for non-wovens having superior softness.

35 Claims, No Drawings

POLYETHYLENE BICOMPONENT FIBERS

FIELD OF THE INVENTION

The present invention relates to thermobondable bicomponent synthetic fibres comprising two different polyethylene components. The fibres are particularly suitable for the preparation of thermally bonded non-woven fabrics for medical use and for non-wovens having superior softness.

BACKGROUND OF THE INVENTION

Various synthetic fibres are known and used in the field of non-wovens for the preparation of non-woven fabrics for a variety of purposes, in particular various polyolefins and polyolefin derivatives, e.g. polypropylene and polyethylene. However, for the purpose of non-woven materials for use in the medical industry both polypropylene fibres and polyethylene fibres suffer from disadvantages which until now have limited the extent of their use. It has furthermore proved difficult to produce non-wovens which have a soft feel resembling that of natural materials, e.g. for use in baby diapers and feminine hygiene products.

GB 2 121 423 A discloses hot-melt adhesive fibres comprising a polyethylene resin composition alone, consisting of 50–100% by weight of polyethylene with a density of 0.910–0.940 g/cm$^3$ and a Q value ($Q=M_w/M_n$) of 4.0 or less and up to 50% by weight of a polyethylene with a density of 0.910–0.930 g/cm$^3$ and a Q value of 7.0 or more, and composite fibres in which the above composition is one of the composite components and forms at least a part of the fibre surface. U.S. Pat. No. 4,522,868 discloses neutron shielding sheath-and-core type composite fibres in which the sheath and core components may be composed of polyethylene or polyethylene copolymers, the core component comprising at least 5% by weight of neutron shielding particles. The fibres are designed for use in neutron shielding fabrics due to the presence of a large amount (preferably 10–60% by weight in the core component) of the neutron shielding particles. The fibres of the present invention, on the other hand, which are adapted for use in various thermally bonded non-woven medical and hygienic products, and not specially adapted for neutron shielding fabrics, need not contain such neutron shielding particles.

It is necessary that non-woven materials which are to be used for medical purposes can be sterilized, this sterilization typically being carried out using radiation, e.g. in the form of γ-radiation or β-radiation. However, polypropylene materials are damaged by such radiation treatments. Even fibres prepared from polypropylene materials which have been stabilized —so-called "radiation resistent" polypropylene —will be damaged at high dosages, because of the very large specific surface area of the fibres (typically about 50–100 m$^2$/kg). Polypropylene's lack of ability to withstand radiation is also seen in bicomponent fibres with a polypropylene core and a sheath of e.g. polyethylene. The effect of radiation on polypropylene is due to the fact that the radiation produces chain scission at the tertiary carbon atoms of the polypropylene molecules. Polyethylene, on the other hand, does not have these tertiary carbon atoms, and is therefore not nearly as susceptible to such radiation. In addition, polyethylene has the ability to form cross-linkages, a property which polypropylene does not have.

Polyethylene is thus able to tolerate the radiation treatments used to sterilize medical products, but known polyethylene fibres also suffer disadvantages which until now have limited the extent of their use. Thus, the use of linear low density polyethylene (LLDPE) has been limited by the fact that it has not been possible to use a high stretch ratio during the preparation of LLDPE fibres, and, more importantly, by the fact that it has not been possible to provide LLDPE fibres with a permanent texturization. As a result, such fibres are unsuitable for the preparation of most types of non-wovens, as the carding processes used for the preparation on non-wovens require that the fibres have a certain texturization. Only non-wovens produced by processes other than carding and thermal bonding can be made with LLDPE fibres. Fibres of high density polyethylene (HDPE), on the other hand, may be provided with a permanent texturization and may be stretched during processing using a high stretch ratio, but HDPE fibres are stiff and therefore unsuitable for non-woven materials in which a soft feel is necessary.

In addition, monocomponent fibres of either LLDPE and HDPE alone are generally unsuitable for thermobonding due to the fact that they have a very narrow "bonding window" (i.e. a narrow temperature range in which they may be thermobonded), thereby making it difficult to adequately control the thermobonding process within the required temperature range. This narrow bonding window is due to the fact that such monocomponent fibres must be softened during thermobonding, but must not melt if they are to contribute to the structure of the article in which they are used.

It has now been found that these problems may be avoided by preparing non-woven fabrics, e.g. for medical use, using thermobondable bicomponent synthetic fibres comprising two different types of polyethylene. It is thus possible according to the present invention to prepare non-woven fabrics using novel fibres which maintain their texturization during processing and therefore are suitable for carding, which have a broad bonding window and therefore are suitable for thermobonding, and which are able to tolerate the γ- and β-radiation used to sterilize medical products. The fibres furthermore have a soft feel and are therefore suitable for the preparation of non-woven materials in which softness is required or desired, e.g. various hygienic products such as coverstock for baby diapers, feminine hygiene products, etc., as well as non-woven materials for medical use.

BRIEF DISCLOSURE OF THE INVENTION

A first aspect of the present invention thus relates to thermobondable bicomponent synthetic fibres comprising a high-melting first component comprising a high density polyethylene with a density of more than 0,945 g/cm$^3$ and a low-melting second component comprising a linear low density polyethylene with a density of less than 0.945 g/cm$^3$.

A second aspect of the invention relates to a method for producing thermobondable bicomponent synthetic fibres comprising melting a high-melting first component comprising a high density polyethylene with a density of more than 0.945 g/cm$^3$ and a low-melting second component comprising a linear low density polyethylene with a density of less than 0.945 g/cm$^3$, spinning the high melting first component and the low melting second component into a spun bundle of bicomponent filaments, stretching the bundle of filaments, crimping the fibres, drying and fixing the fibres, and cutting the fibres to produce staple fibres.

A third aspect of the invention relates to a thermally bonded non-woven fabric comprising the thermobondable bicomponent polyethylene fibres described above.

A fourth aspect of invention relates to a method for producing a thermally bonded non-woven fabric comprising the thermobondable bicomponent polyethylene fibres described above, the method comprising drylaid carding and calender bonding of the thermobondable bicomponent fibres at a temperature above the melting point of the low melting component of the fibres and below the melting point of the high melting component of the fibres.

The fibres of the invention are the first truly bondable polyethylene bicomponent staple fibres, and are characterized by an excellent cardability and thermal bondability, low bonding temperatures, good non-linting features, and the ability to be bonded directly to polyethylene film or other polyethylene non-wovens. Furthermore, the non-wovens prepared from the fibres are capable of withstanding ionizing radiation sterilization with only insignificant losses in web strength. Thus, it has been found that at radiation levels commonly used in the medical industry (2.5 megarads of γ- or β-radiation), the fibres maintain their physical integrity and characteristics. At 5 megarads of β-radiation, the fibres have been found to retain up to about 94–96% of their initial strength 6 months after exposure to radiation. Similarly, non-wovens prepared from the fibres have been found to retain up to 80–90% of their initial strength and 90–100% of their initial elongation at break. In comparison, the strength of ordinary polypropylene fibres typically is reduced to about 60% of the initial strength immediately after irradiation and to about 20% of the initial strength 3 months after irradiation. The tenacity of non-wovens prepared from ordinary polypropylene fibres is typically reduced immediately after irradiation to about 30–40% of the initial tenacity.

DETAILED DISCLOSURE OF THE INVENTION

The term "high density polyethylene" or "HDPE" as used in the context of the present invention refers to polyethylene having a density of more than 0.945 g/cm$^3$, typically at least 0.950 g/cm$^3$, in particular between 0.951 and 0.966 g/cm$^3$, e.g. between 0.955 and 0.965 g/cm$^3$. HDPE is a homopolymer of poly(ethylene) or a copolymer of ethylene with a small content, typically up to about 2%, of a higher olefin, in particular 1-butene, 1-hexene, 4-methyl-1-pentene, 1-octene or other higher alkenes. The melting point of the HDPE is at least about 130° C., typically 131°–135° C. HDPE is produced by a low pressure process and has a linear structure with some short chain branching, but without any substantial long chain branching.

While specific melting points are referred to herein in connection with the components employed in the preparation of the fibres of the invention, it must be kept in mind that these materials, as all crystalline polymeric materials, in reality melt gradually over a range of a few degrees. The melting points referred to herein are peak temperatures determined by differential scanning calorimetry (DSC). The precise melting temperature in any given case depends upon the nature of the raw material, its molecular weight and crystallinity.

The HDPE generally has a melt flow index (MFI) of between 2 and 20 g/10 min, preferably between 3 and 18 g/10 min, more preferably between 7 and 15 g/10 min. The term "melt flow index" in the context of the present invention is determined as the amount of material (g/10 min) which is pressed through a die at 190° C. and a load of 2.16 kg (ASTM D 1238-86, condition 190/2.16 (formerly condition E), which is equal to DIN 53735, code D (1983)).

It is preferred that the HDPE has a narrow molecular weight distribution, since this improves the spinnability allowing spinning of finer fibres, or, alternatively, allowing the use of higher spinning speeds. The high spinnability of the high density/high melting component "carries" the other component during the spinning process, and thus affects the maximum spinning speed which may be used.

The HDPE is preferably stabilized so that degradation of the fibres (chain scission or cross binding as well as partial oxidation, all of which reduce the spinnability of the fibres) is avoided. This is e.g. performed using a phosphite-based process stabilizer, such as Irgafos 168 (phenol,2,4-bis(1,1-dimethylethyl)-,phosphite (3:1)) from Ciba-Geigy. The HDPE is furthermore preferably stabilized with an antioxidant to avoid surface oxidation during spinning of the fibres, for example with a phenolic antioxidant, e.g. Irganox 1076 (benzenepropanoic acid 3,5-bis(1,1-dimethylethyl)-4-hydroxy-, octadecyl ester) or Irganox 1425 (phosphonic acid, [[3,5-bis(1,1-dimethylethyl)-4-hydroxyphenyl]methyl]-, monoethyl ester, calcium salt (2:1)) from Ciba-Geigy. A secondary antioxidant which functions as a radical scavenger may advantageously be employed, e.g. a hindered amine light stabilizer such as Chimassorb 944 from Ciba-Geigy (poly-([6-[(1,1,3,3-tetramethylbutyl)-imino]-1,3,5-triazine-2,4-diyl][2-(2,2,6,6-tetramethylpiperidyl)-amino]-hexamethylene-[4-(2,2,6,6-tetramethylpiperidyl)-imino])). Stabilizers are added to the polymer material prior to melting and spinning of the fibres. Stabilizer additive levels are typically less than about 1000 ppm.

In particular, when the fibres are to be used for medical purposes, one should attempt to select a combination of stabilizers which prevents damage to the fibres during subsequent sterilization by ionizing radiation. An anti-gasfading combination is also preferred (the term "gasfading" referring to a discolouration which occurs as a result of chemical reactions between the additive and nitrogenous exhaust gasses). Examples of such anti-gasfading stabilizers are the above-mentioned stabilizers Irganox 1076 and 1425 from Ciba-Geigy.

The term "linear low density polyethylene" or "LLDPE" as used in the context of the present invention refers to polyethylene having a density of less than 0.945 g/cm$^3$, typically from 0.921 to 0.944 g/cm$^3$, more typically from 0.925 to 0.940 g/cm$^3$, e.g. from 0.930 to 0.938 g/cm$^3$. LLDPE is prepared using a low pressure process and, as the name implies, has a linear structure, i.e. with a higher short chain branching frequency than HDPE, but without substantial long chain branching. LLDPE is a copolymer of ethylene with up to about 15% of a higher olefin, in particular 1-butene, 1-hexene, 4-methyl-1-pentene, 1-octene or other higher alkenes, or a derivative thereof, e.g. ethyl vinyl acetate, (EVA).

The melting point of the LLDPE is at the most about 127° C., typically between 123° C. and 126° C., and the melt flow index is typically between 10 and 45 g/10 min, preferably between 12 and 28 g/10 min. It is preferred that the MFI of the LLDPE component is higher than that of the HDPE component.

The LLDPE component is preferably stabilized as described above for the HDPE component.

While the preferred fibres according to the present invention comprise a high-melting first component comprising a high density polyethylene and a low-melting second component comprising a linear low density polyethylene as explained above, it is also contemplated that the first and/or second components also may comprise other types of polyethylenes or polyethylene-based materials.

Thus, it is contemplated that the high-melting first component may comprise medium density polyethylene (MDPE), this term referring to polyethylene types with a density of between 0.935 and 0.950 g/cm$^3$. It is also possible to blend different types of HDPE having different melt flow indexes, e.g. one with an MFI of about 7 g/10 min and one with an MFI of about 11 g/10 min.

Similarly, mixtures of more than one type of LLDPE may be used for the low-melting second component, e.g. one LLDPE with an MFI of about 18 g/10 min and one LLDPE with an MFI of about 25 g/10 min. In addition to LLDPE, low density polyethylene (LDPE—a type of low density polyethylene prepared by a high pressure process and having significant long chain branching) may also be employed as the low-melting second component. While LDPE has a poorer spinnability than LLDPE, it is possible to use LDPE for preparation of the fibres of the invention due to the superior spinnability of the high-melting first component. LDPE typically has a density which substantially corresponds to that which is given above for LLDPE, but a slightly lower melting point, i.e. less than about 120° C., typically about 115° C. Furthermore, low density polyethylene copolymers having a very low density (very low density polyethylene, VLDPE; and ultra low density polyethylene, ULDPE) may also be employed as the low-melting second component.

The weight ratio between the first and second components in the fibres is from 10:90 to 90:10, typically from 30:70 to 70:30, preferably from 40:60 to 65:35.

PREPARATION OF THE FIBRES

The individual steps involved in the preparation of the fibres of the invention will be described in detail in the following:

Spinning

The constituents of the high melting first component and the low melting second component, respectively, are melted in separate extruders (one extruder for each of the two components), which mix the respective components such that the melts have a uniform consistency and temperature prior to spinning. The temperatures of the melted components in the extruders are well above their respective melting points, typically more than about 80° C. above the melting points, thus assuring that the melts have flow properties which are appropriate for the subsequent spinning of the fibres.

The melted components are typically filtered prior to spinning, e.g. using a metal net, to remove any unmelted or cross-linked substances which may be present. The spinning of the fibres is typically accomplished using conventional melt spinning (also known as "long spinning"), in particular medium-speed conventional spinning, but so-called "short spinning" or "compact spinning" may also be employed (Ahmed, M., *Polypropylene Fibers—Science and Technology,* 1982). Conventional spinning involves a two-step process, the first step being the extrusion of the melts and the actual spinning of the fibres, and the second step being the stretching of the spun ("as-spun") fibres. Short spinning is a one-step process in which the fibres are both spun and stretched in a single operation.

The melted components, as obtained above, are led from their respective extruders, through a distribution system, and passed through the holes in a spinnerette. Producing bicomponent fibres is more complicated than producing monocomponent fibres, because the two components must be appropriately distributed to the holes. Therefore, in the case of bicomponent fibres, a special type of spinnerette is used to distribute the respective components, for example a spinnerette based on the principles described in U.S. Pat. No. 3,584,339 or U.S. Pat. No. 4,717,325. The diameter of the holes in the spinnerette is typically about 0.3–1.2 mm, depending on the fineness of the fibres being produced. The extruded melts are then led through a quenching duct, where they are cooled and solidified by a stream of air, and at the same time drawn into bicomponent filaments, which are gathered into bundles of filaments. The bundles typically contain at least about 100 filaments, more typically at least about 700 filaments. The spinning speed after the quenching duct is typically at least about 200 m/min, more typically about 400–2000 m/min.

The configuration of the bicomponent fibre should be such that the low melting component constitutes the major part of the surface of the fibre. Thus, the fibres are preferably of the sheath-and-core type, with either a "concentric" or "eccentric" configuration. A concentric configuration is characterized by the sheath component having a substantially uniform thickness, the core component lying approximately in the centre of the fibre. In an eccentric configuration, the thickness of the sheath component varies, and the core component therefore does not lie in the centre of the fibre. In either case, the core component is substantially surrounded by the sheath component. However, in an eccentric bicomponent fibre, a portion of the core component may be exposed, so that in practice up to about 30% of the surface of the fibre may be constituted by the core component.

A side-by-side configuration is not preferred for the fibres of the invention, since it is believed that fibres with a side-by-side configuration will be susceptible to delamination, i.e. splitting of the fibres into the two components, during the carding or stretching process.

Stretching

Due to the structure of the fibres of the invention, i.e. the fact that they are prepared as bicomponent fibres, it is possible to stretch the fibres using a higher stretch ratio than that which is normally possible when using LLDPE, which is advantageous for two reasons. First of all, it is possible to spin thicker fibres, which allows a greater production capacity and provides better technical possibilities, e.g. making it easier to control degradation during cooling of the fibres due to the smaller specific surface area of thick fibres. Secondly, stretching provides the spun fibres with an increased orientation of the molecular chains. A greater degree of orientation leads to an increased crystallization, which in turn provides a stiffer fibre. The stiffer the fibre, the more permanent is the texturization which may be obtained, this texture being critical for carding of the fibres during preparation of the non-woven materials.

Stretching is preferably performed using so-called off-line stretching or off-line drawing, which, as mentioned above, takes place separately from the spinning process. The stretching process typically involves a series of hot rollers and a hot air oven, in which a number of bundles of filaments are stretched simultaneously. The bundles of filaments pass first through one set of rollers, followed by passage through a hot air oven, and then passage through a second set of rollers. Both the hot rollers and the hot air oven typically have a temperature of about 50°–105° C., more typically about 70°–95° C. The speed of the second set of rollers is faster than the speed of the first set, and the heated bundles of filaments are therefore stretched according to the ratio between the two speeds (called the stretch ratio or draw ratio). A second oven and a third set of rollers can also be used (two-stage stretching), with the third set of rollers having a higher speed than the second set. In this case the stretch ratio is the ratio between the speed of the last and the first set of rollers. Similarly, additional sets of rollers and ovens may be used. The fibres of the present invention are typically stretched using a stretch ratio of from about 2.5:1 to about 6:1, and preferably about from about 3.0:1 to about 5.0:1, resulting in an appropriate fineness, i.e. about 1–7 dtex, typically about 1.5–5 dtex, preferably about 2.2–3.8 dtex.

Due to the relatively high stretch ratios used according to the present invention, a two-step stretching process is preferred in order to achieve a more uniform stretching without breaking the weak filaments. As explained above, the higher the stretch ratio is, the stiffer the fibres will be, thereby providing a better and more permanent texturization but generally slightly poorer thermobonding characteristics. The choice of stretch ratio is thus a compromise between these characteristics and must therefore be made after an individual assessment in each case according to the particular characteristics desired in the finished fibres, as well as according to the nature of the raw materials used. A hydrophilic or hydrophobic spin finish can optionally be added before texturization.

Texturization

Texturization (crimping) of the stretched fibres is performed in order to make the fibres suitable for carding by giving them a "wavy" form. It is necessary, however, that the texturization is permanent, so that the fibres are not stretched out and the texturization lost during passage through the first rollers in the carding machine; if this happens, the fibres will block the carding machine. An effective texturization, i.e. a relatively large number of crimps in the fibres, allows for high processing speeds in the carding machine, typically up to at least 100 m/min, and thus a high productivity, since a high web cohesion is obtained in the carding web.

Crimping is typically carried out using a so-called stuffer box. The bundles of filaments are led by a pair of pressure rollers into a chamber in the stuffer box, where they become crimped due to the pressure that results from the fact that they are not drawn forward inside the chamber. The degree of crimping can be controlled by the pressure of the rollers prior to the stuffer box, the pressure and temperature in the chamber and the thickness of the bundle of filaments. As an alternative, the filaments can be air-texturized by passing them through a nozzle by means of a jet air stream.

The fibres are typically texturized to a level of up to about 15 crimps/cm, preferably from 5 to 12 crimps/cm.

As mentioned above, it has until now not been possible to achieve permanent texturization in LLDPE fibres. While it is possible to subject such fibres to a texturizing process, the fibres are so soft that any texture obtained is not permanent, even when the fibres are subsequently subjected to an effective fixation step (see below). The fibres therefore easily become uncrimped during later processing and are unsuitable for carding. A very important advantage of the bicomponent synthetic fibres of the present invention is thus the fact that they are able to be permanently texturized. This ability is believed to be related to the relatively high stretch ratio which may be employed, the bicomponent structure and the high stretch ratio providing a rigid, supporting "core" comprising the HDPE component, while the LLDPE component remains soft.

While it might be possible to prepare a HDPE fibre with a greater degree of permanent texturization, such a fibre would have to be highly stretched and quite stiff, and would therefore be unsuitable for thermobonding.

Fixation

After the fibres have been crimped, e.g. in a stuffer box, they are typically fixed by heat treatment in order to reduce tensions which may be present after the stretching and crimping processes, thereby making the texturization more permanent. Fixation and drying of the fibres may take place simultaneously, typically by leading the bundles of filaments from the stuffer box, e.g. via a conveyer belt, through a hot-air oven. The temperature of the oven will depend on the composition of the bicomponent fibres, but must obviously be below the melting point of the low melting component. During the fixation the fibres are subjected to a crystallization process which "locks" the fibres in their crimped form, thereby making the texturization more permanent. The heat treatment also removes a certain amount of the moisture which has been applied to the fibres during their preparation.

Cutting

The fixed and dried bundles of filaments are then led to a cutter, where the fibres are cut to staple fibres of the desired length. Cutting is typically accomplished by passing the fibres over a wheel containing radially placed knives. The fibres are pressed against the knives by pressure from rollers, and are thus cut to the desired length, which is equal to the distance between the knives. The fibres of the present invention are typically cut to staple fibres of a length of about 18–150 mm, more typically 25–100 mm, in particular 30–60 mm, e.g. about 40 mm.

PREPARATION ON NON-WOVENS

As mentioned above, the fibres of the present invention are particularly suitable for the preparation of non-woven fabrics, e.g. for medical use and for use in personal hygienic products. Thus, the present invention also relates to non-woven materials comprising the thermobondable bicomponent synthetic fibres described above.

Due to the advantageous properties of the bicomponent polyethylene fibres of the invention, especially the fact that they can be processed by carding equipment without losing their texturization, it is possible to prepare non-woven materials which consist essentially or entirely of these fibres, for example when non-linting products are desired. However, it is of course also possible to prepare non-woven materials in which only a portion of the fibres are the bicomponent polyethylene fibres of the invention, the other fibres typically being non-thermobondable fibres such as viscose fibres, cotton fibres and other dyeable fibres. The non-woven materials containing the fibres of the invention typically have a base weight in the range of 6–120 g/m$^2$, more typically 15–50 g/m$^2$.

The non-woven materials containing the bicomponent polyethylene fibres of the invention may be prepared by methods known in the art, and are typically prepared by drylaid carding and calender bonding of the thermobondable bicomponent fibres at a temperature above the melting point of the low melting component of the fibres and below the melting point of the high melting component of the fibres. Calender bonding of the fibres of the invention is typically performed at a temperature of from about 126° C. to about 132° C. As explained above, the non-woven material may contain only the bicomponent fibres, but other fibres, e.g. non-thermobondable fibres such as those mentioned above, may if desired also by incorporated into the materials during the carding process.

Carding

As explained above, it is important that the staple fibres are provided with a permanent texturization, so that they may be carded effectively. The higher the friction between the individual fibres—this friction resulting from the crimped, wavy form of the texturized fibres—the faster and more intensively the fibres can be processed by the carding machine.

The suitability of staple fibres for carding may be determined using a simple web cohesion test. This test is carried out by measuring the length a carding web of approximately 10 g/m$^2$ can support in a substantially horizontal position before it breaks due to its own weight, the length of the carding web being increased at a rate of about 15 m/min. Fibres which are well suited for carding will typically be able to support about 1.0 m or more in this test. Polypropylene fibres will typically be able to support somewhat more, e.g. about 1.5–2.25 m, while for LLDPE fibres (i.e. without permanent texturization) a length of not more than about 0.25 m will generally be achieved. For the bicomponent fibres of the present invention lengths of about 1.0–1.5 m are typically obtained. A minimum web cohesion length (using the above-described test) of about 0.5–0.75 m is generally required for carding under normal production conditions. In other words, the bicomponent fibres may be characterized according to the above-described test as being well suited for carding.

Thermobonding

A good (monocomponent) staple fibre for thermobonding should be soft and not oriented or texturized to provide a soft, but strong non-woven. However, these characteristics normally mean that the fibres are unsuitable for carding.

Thermobonding using monocomponent fibres is performed by pressing the fibres together by hot roller calender bonding at a temperature close to, but below, the fibres' melting temperature. Often one of the rollers is embossed, i.e. engraved with a pattern, to provide point bonding. This results in a strong bonding at the points with a bulky and thus soft non-woven material in between. The relatively high temperature used for hot roller calender bonding results in fibres which are softened, so they are deformed under pressure, and also sticky, so they bond to other fibres, thereby providing the non-woven product with a high strength, but the fibres do not melt during the process. A HDPE fibre will therefore be poorly suited for use in thermobonding, since it is stiff and highly oriented, and thus difficult to deform under pressure. A fibre of LLDPE, on the other hand, is suitable for thermobonding, since it is soft; it just cannot be carded.

Bicomponent fibres are thermobonded in a different manner: The temperature used for thermobonding is slightly above the melting point of the low-melting component, and this component therefore flows under a relatively low pressure (when hot roller calender bonding is used) or optionally without any pressure being applied (when bonding in a hot air oven is used). The high-melting component remains stiff and maintains its fibre structure under the thermobonding process, thereby providing the finished non-woven product with a high strength.

One of the advantages of the HDPE/LLDPE bicomponent fibres of the present invention, compared with monocomponent fibres, is that there is a certain difference (typically about 7°–8° C.) between the melting point of the high-melting component and that of the low-melting component. This provides a temperature range (bonding window) of e.g. about 5° C. in which the low-melting component is soft and flows easily while the high-melting component is stiff and hard. This is in contrast to the bonding window for fibres of either LLDPE or HDPE, which in either case is quite narrow, i.e. about 1°–2° C. It is clear that it is extremely difficult to maintain a temperature within such a narrow interval of 1°–2° C. in all parts of the calender rollers in a full-scale production process.

The present invention is further illustrated by the following non-limiting examples. All of the fibres described below were produced using a 50:50 weight ratio between the HDPE component and the LLDPE component unless otherwise specified. The fineness of the fibres was measured according to DIN 53812/2, the elongation at break and tenacity of the fibres was measured according to DIN 53816, and the crimp frequency was measured according to ASTM D 3937-82.

EXAMPLE 1

Bicomponent sheath-and-core type fibres according to the present invention with an eccentric configuration were prepared by conventional spinning using a spinning speed of 550 m/min, resulting in an "as-spun" bundle of several hundred bicomponent filaments. The following components were used:

Core component: high density polyethylene, melt flow index 7 g/10 min, density 0.965 g/cm$^3$, extruded at 213° C.

Sheath component: linear low density polyethylene (a copolymer of ethylene and 1-octene, so-called octene-baased LLDPE), melt flow index 26 g/10 min, density 0.940 g/cm$^3$, extruded at 211° C.

Off-line stretching of the filaments was carried out in a two-stage drawing operation using a combination of hot rollers and a hot air oven, with temperatures between 90° C. and 95° C., and a stretch ratio of 3.6:1. The stretched filaments were then crimped in a stuffer-box crimper. The filaments were annealed in an oven at a temperature of 105° C. to reduce contraction of the fibres during the thermal bonding process. The fibres were subsequently cut to a length of 45 mm.

The finished bicomponent fibres had a fineness of 3.3–4.4 dtex, a tenacity of 1.8–2.2 cN/dtex, an elongation at break of 180–220%, and about 8–10 crimps/cm. The web cohesion length of the fibres (as determined by the method described above, i.e. by measuring the length a carding web of approximately 10 g/m$^2$ can support before it breaks due to its own weight) was 1.2 m.

EXAMPLE 2

Bicomponent sheath-and-core type fibres with a concentric configuration were prepared as described in Example 1, with the following exceptions:

The extruding temperatures were 240° C. (for the core component) and 235° C. (for the sheath component). The core component was as given in Example 1, while the sheath component was an octene-based LLDPE with a melt flow index of 12 g/10 min and a density of 0.935 g/cm$^3$. The fibres were stretched as described in Example 1.

The resulting fibres had a fineness of 3.3–3.8 dtex, a tenacity of 2.1–2.4 cN/dtex and an elongation at break of 200–230%. The web cohesion length was 1.5 m.

EXAMPLE 3

Bicomponent sheath-and-core type fibres with a concentric configuration were prepared by the method described in Example 1 using a spinning speed of 480 m/min and the following components:

Core component: high density polyethylene, melt flow index 15 g/10 min, density 0.955 g/cm$^3$, extruded at 227° C.

Sheath component: butene-based LLDPE, melt flow index 26 g/10 min, density 0.937 g/cm$^3$, extruded at 225° C.

The stretch ratio was 5.0:1. The resulting fibres had a fineness of about 2.2 dtex, a tenacity of 1.9–2.3 cN/dtex, and an elongation at break of 160–190%. The web cohesion length was 1.0 m.

EXAMPLE 4

Preparation of a non-woven material using bicomponent polyethylene fibres

Fibres prepared as described in Example 1 were carded and thermally bonded using a Trözler preopener and a Spinnbau randomizing card, with a single tambour, double doffer system, producing a 60 cm wide carded web with a base weight of about 25 g/m$^2$. The web was led via a conveyor belt to a pair of hot calender rollers with a line pressure of 40 daN/cm and a diamond-shaped pattern with a bonding area of the embossed roller of 22%. The web was bonded to a non-woven product at temperatures of between 126° C. and 131° C. at a speed of 50 m/min.

A non-woven sample, bonded at 130° C., had a tenacity of 17 N/5 cm in the machine direction and 3 N/5 cm in the transverse direction, as measured in a tensile drawing test at 20° C. on test pieces with a width of 5 cm and a length of more than 20 cm, using a draw speed of 10 cm/min. The test method used was the EDANA recommended test: Nonwovens Tensile Strength, 20 February, 1989, which is based on ISO 9073–3:1989; however, for the purposes of the present invention the relative humidity was not maintained at 65%.

EXAMPLE 5

A non-woven material was prepared essentially as described in Example 4, but with the fibres of Example 2 and using a bonding speed of 80 m/min.

A non-woven sample bonded at 131° C. and tested as described in Example 4 had a tenacity of 27 N/5 cm in the machine direction and 6.8 N/5 cm in the transverse direction.

EXAMPLE 6

As a reference a normal (monocomponent) fibre was made by blending two different polyethylene materials, a high density polyethylene with a melt flow index of 7 g/10 min and a density of 0.965 g/cm$^3$, and a linear low density polyethylene with a melt flow index of 18 g/10 min and a density of 0.937 g/cm$^3$, in a 50:50 ratio. Fibres were extruded at a temperature of 225° C. as "biconstituent" fibres (i.e. fibres containing a mixture of the two polyethylene materials), which were subjected to stretching as in Example 1. The fibres had a fineness of 3.3 dtex, a tenacity of 1.9 cN/dtex, and a web cohesion length of 1.0 m.

The fibres could be carded at 50 m/min, but calender bonding as described in Example 4 led to a non-woven material of very poor tenacity, less than 0.6 N/5 cm in both the machine and transverse directions.

EXAMPLE 7

Bicomponent sheath-and-core type fibres with a concentric configuration were prepared using the method described in Example 1. The following components were used:

Core component: as in Example 1, but with extrusion at 227° C.

Sheath component: octene-based LLDPE, melt flow index 18 g/10 min, density 0.930 g/cm$^3$, extruded at 223° C.

Spinning speeds of 480 m/min, 690 m/min and 780 m/min, respectively, were used, along with a stretch ratio of 4.0:1, resulting in fibres with a fineness of 3.3, 2.2 and 1.7 dtex, respectively (corresponding to the respective spinning speeds). The fibres had tenacities of 2.1, 2.6 and 2.7 cN/dtex, respectively, and elongation at break of 190%, 120% and 110%, respectively. The web cohesion length was 1.25, 1.0 and 0.5 m, respectively.

EXAMPLE 8

A non-woven material was prepared from the fibres of Example 7 using the method described in Example 4, but with a bonding speed of 80 m/min.

The 3.3 dtex fibres could be bonded at temperatures in the range of 126°–132° C., giving non-wovens with tenacities greater than 20 N/5 cm in the machine direction at 23 g/m$^2$. The maximum tenacity was 35 N/5 cm in the machine direction and 7.2 N/5 cm in the transverse direction for a non-woven bonded at 131° C.

The 2.2 dtex fibres gave maximum tenacities of 22 N/5 cm in the machine direction and 6.6 N/5 cm in the transverse direction using a bonding temperature of 132° C.

The 1.7 dtex fibres were difficult to card, and a commercially satisfactory non-woven material could not be made from these fibres.

EXAMPLE 9

Fibres were prepared as described in Example 7, but with extrusion at 260° C. and 240° C., respectively, for the core and sheath components. Using a stretch ratio of 6.1:1, fibres with a fineness of 3.3 dtex were prepared. The fibres had a tenacity of 2.1 cN/dtex and an elongation at break of 200%.

EXAMPLE 10

Fibres were prepared as described in Example 1 using a spinning speed of 350 m/min and the following components:

Core component: high density polyethylene with an MFI of 7 g/10 min, density 0.963 g/cm$^3$, and a narrow molecular weight distribution, characterized by a $M_w/M_n$ ratio of 3.5, measured by GPC (gel permeation chromatography), extruded at 229° C.

Sheath component: as in Example 7, extruded at 227° C.

The fibres, which were stretched at a stretch ratio of 4.0:1 to a final fineness of 3.4–3.5 dtex, had a tenacity of 2.1–2.3 cN/dtex, an elongation at break of 200–230%, and 9–12 crimps/cm. The web cohesion length was 1.2 m. The fibres were cut to a length of 40 mm.

EXAMPLE 11

Fibres prepared as described in Example 10 were used to prepare a non-woven material by the method described in Example 4, with the exception that the carding speed was 80 m/min. The fibres were bondable at temperatures in the range of 126°–132° C., giving non-wovens with tenacities greater than 44 N/5 cm in the machine direction and 7.6 N/5 cm in the transverse direction for a web with a weight of 25 g/m$^2$.

EXAMPLE 12

Fibres were prepared as described in Example 7, but with a core/sheath weight ratio of 35:65, a sheath component extrusion temperature of 229° C., and a spinning speed of 480 m/min. The fibres had a fineness of 3.3 dtex, a tenacity at break of 2.0 cN/dtex, and an elongation at break of 190%. The web cohesion length was 1.0 m.

A non-woven material prepared as described in Example 8 had at 26 g/m$^2$ a maximum tenacity of 23 n/5 cm in the machine direction and 3.3 N/5 cm in the transverse direction using a bonding temperature of 130° C.

EXAMPLE 13

Fibres were prepared as described in Example 10, except that a spinning speed of 480 m/min was used, and the fibres had core/sheath weight ratios of 60:40 and 65:35. The two fibres had tenacities of 2.3 and 2.4 cN/dtex, respectively; both had an elongation at break of 190%.

Non-woven materials prepared as in Example 8 from the two fibres using a bonding speed of 80 m/min and a bonding temperature of 130° C. at 25 g/m$^2$ a maximum tenacity of 30 and 34 n/5 cm in the machine direction and 5.5 and 5.8 N/5 cm in the transverse direction, respectively, for fibres with the two core/sheath ratios.

EXAMPLE 14

Fibres were prepared as described in Example 10 using a spinning speed of 500 m/min. The fibres had a fineness of 2.2–2.4 dtex, a tenacity of 2.3–2.4 cN/dtex, and an elongation at break of 150–170%.

Non-woven materials were prepared as described in Example 4 using a bonding speed of 60 m/min. The materials had a tenacity of 45 N/5 cm in the machine direction and 8.6 N/5 cm in the transverse direction at 25 g/cm$^2$.

EXAMPLE 15

Non-wovens prepared as described in Example 8 using 3.3 dtex fibres were irradiated with 2.5 and 5.0 megarads of β-radiation. Six months after irradiation, the tenacity of the non-wovens was found to be about 88% and 62%, respectively, of the initial tenacity.

For comparison 2.2 dtex fibres were spun from a "radiation resistant" polypropylene and 20 g/cm$^2$ non-wovens prepared from these fibres were exposed to 2.5 and 5.0 megarads of β-radiation. The polypropylene fibres exposed to both radiation levels were found to retain only 75% of the initial strength one month after irradiation, and the corresponding non-wovens prepared from these fibres had only 30–40% of their initial strength and 40–45% of their initial elongation at break after one month.

EXAMPLE 16

The fibres of Example 7 were sterilized using 2.5 and 5.0 megarads of β-radiation. The irradiated fibres were found to retain 90% and 81%, respectively, of their initial strength, and 100% and 87%, respectively, of their initial elongation at break after 6 months.

For comparison 2.2 dtex fibres were spun from a "radiation resistant" polypropylene and exposed to 2.5 and 5.0 megarads of β-radiation. The strength of the polypropylene fibres was reduced to 85% and 75%, respectively, of the initial strength, and the elongation at break of the fibres was reduced to 95% and 86%, respectively, of the initial elongation at break immediately after irradiation. It is expected that the mechanical properties of the polypropylene fibres will be significantly poorer 3–4 months after irradiation, since the weakening of polypropylene fibres after irradiation is a well-known phenomenon.

What is claimed is:

1. A thermobondable bicomponent synthetic fiber comprising a high-melting core component and a low-melting sheath component substantially surrounding said core component, said core component comprising high density polyethylene having a density of at least 0.950 g/cm$^3$ and a melting point of at least 130° C., said sheath component comprising linear low density polyethylene having a density in the range of from 0.921 to 0.944 g/cm$^3$ and a melting point not greater than 127° C., said core component and said sheath component being present in a weight ratio of core component to sheath component within the range of 10:90 to 90:10, wherein said fiber is permanently texturized.

2. The fiber according to claim 1, wherein the high density polyethylene has a density of between 0.951 and 0.966 g/cm$^3$.

3. The fiber according to claim 1, wherein the linear low density polyethylene has a density of between 0.925 and 0.940 g/cm$^3$.

4. The fiber according to claim 1, wherein the core component has a melting point in the range of from 131° to 135° C.

5. The fiber according to claim 1, wherein the sheath component has a melting point in the range of from 123° to 126° C.

6. The fiber according to claim 1, wherein the core component has a melt flow index of from 2 to 20 g/10 min.

7. The fiber according to claim 1, wherein the sheath component has a melt flow index of from 10 to 45 g/10 min.

8. The fiber according to claim 1, wherein the fiber is a staple fiber having a length of 18–150 mm.

9. The fiber according to claim 8, wherein the fiber is a staple fiber having a length of 25–100 mm.

10. The fiber according to claim 9, wherein the fiber is a staple fiber having a length of 30–60 mm.

11. The fiber according to claim 10, wherein the fiber is a staple fiber having a length of about 40 mm.

12. The fiber according to claim 1, wherein the fiber has a fineness of 1–7 dtex.

13. The fiber according to claim 12, wherein the fiber has a fineness of 1.5–5 dtex.

14. The fiber according to claim 13, wherein the fiber has a fineness of 2.2–3.8 dtex.

15. The fiber according to claim 1, wherein said permanent texture comprises crimps at a level less than or equal to 15 crimps/cm.

16. The fiber according to claim 15, wherein said permanent texture comprises crimps at a level of from 5 to 12 crimps/cm.

17. The fiber according to claim 7, wherein the sheath component has a melt flow index of from 12–28 g/10 min.

18. The fiber according to claim 6, wherein the core component has a melt flow index of from 3–18 g/10 min.

19. The fiber according to claim 18, wherein the core component has a melt flow index of from 7–15 g/10 min.

20. A method for producing a thermobondable bicomponent synthetic staple fiber, which comprises:

separately melting (1) a high-melting first component, which comprises a high density polyethylene having a density of at least 0.950 g/cm$^3$ and a melting point of at least 130° C., and (2) a low-melting second component, which comprises a linear low density polyethylene having a density in the range of from 0.921 to 0.944 g/cm$^3$ and a melting point not greater than 127° C.;

spinning the melted first component and the melted second component into a spun bundle of bicomponent filaments, each filament having a sheath-and-core configuration wherein said first component constitutes the core and said second component constitutes the sheath, and wherein said first and second components are present in a weight ratio within the range of 10:90 to 90:10, respectively;

stretching the bundle of filaments;

crimping the filaments;

fixing the filaments; and cutting the filaments to thereby produce permanently texturized staple fibers.

21. The method according to claim 20, wherein the fibers are cut to a length of 18–150 mm.

22. The method according to claim 21, wherein the fibers are cut to a length of 25–100 mm.

23. The method according to claim 22, wherein the fibers are cut to a length of 30–60 mm.

24. The method according to claim 23, wherein the fibers are cut to a length of about 40 mm.

25. The method according to claim 20, wherein the fibers are texturized to a level of up to 15 crimps/cm.

26. The method according to claim 25, wherein the fibers are texturized to a level of from 5 to 12 crimps/cm.

27. The method according to claim 20, wherein the stretch ratio is within the range of 2:1 to 6:1.

28. The method according to claim 27, wherein the stretch ratio is within the range of 3.0:1 to 5.0:1.

29. The method according to claim 20, wherein the filaments are spun using conventional melt spinning with off-line stretching.

30. The method according to claim 20, wherein the filaments are spun using short spinning technology.

31. A thermally bonded non-woven fabric comprising thermobondable bicomponent polyethylene fibres according to any of claim 22.

32. A non-woven fabric according to claim 31 which consists essentially of the thermobondable bicomponent polyethylene fibres.

33. A non-woven fabric according to claim 31 which further comprises other fibres, e.g. non-thermobondable fibres selected from the group consisting of viscose fibres, cotton fibres and other dyeable fibres.

34. A method for producing a thermally bonded non-woven fabric, the method comprising drylaid carding and calender bonding thermobondable bicomponent polyethylene fibres according to any of claim 22 at a temperature above the melting point of the low melting component of the fibres and below the melting point of the high melting component of the fibres.

35. A method according to claim 20 wherein calendar bonding is performed at a temperature of from 126° C. to 132° C.

* * * * *